US006663505B1

(12) United States Patent
Solari

(10) Patent No.: US 6,663,505 B1
(45) Date of Patent: Dec. 16, 2003

(54) PUTTER HEAD CONSTRUCTION

(76) Inventor: Ray L. Solari, 531 Main St., Ste 1105, El Segundo, CA (US) 90245

( * ) Notice: Subject to any disclaimer, the term of this patent is extended or adjusted under 35 U.S.C. 154(b) by 0 days.

(21) Appl. No.: 10/267,892

(22) Filed: Oct. 10, 2002

(51) Int. Cl.[7] ..... A63B 53/04
(52) U.S. Cl. ..... 473/334; 473/338; 473/340
(58) Field of Search ..... 473/324, 334, 473/335, 336, 337, 338, 339, 340, 341, 349, 313, 251, 288, 290, 291, 328; D21/736

(56) References Cited

U.S. PATENT DOCUMENTS 1,538,312 A * 5/1925 Beat ..... 473/337
2,332,342 A * 10/1943 Reach ..... 473/248
3,143,349 A * 8/1964 MacIntyre ..... 473/338
4,043,563 A * 8/1977 Churchward ..... 473/338
4,085,934 A * 4/1978 Churchward ..... 473/338
4,655,459 A * 4/1987 Antonious ..... 473/338
4,695,054 A * 9/1987 Tunstall ..... 473/338
5,050,879 A * 9/1991 Sun et al. ..... 473/338
5,518,243 A * 5/1996 Redman ..... 473/334
5,601,499 A * 2/1997 Segaline ..... 473/313
6,409,612 B1 * 6/2002 Evans et al. ..... 473/324

* cited by examiner

*Primary Examiner*—Sebastiano Passaniti

(57) ABSTRACT

A golf putter head portion (10) has a lower surface that is convexly curved about two orthogonal axes (C1, C2). A weight storing housing (14) is formed in the lower surface for receiving a selective number of weights (24) to provide a predetermined overall putter head weight and center of percussion customized for an individual. A cover (26) lockingly snaps in place over the housing opening.

6 Claims, 1 Drawing Sheet

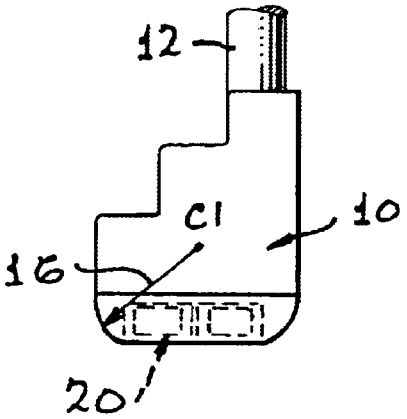
FIG. 1
FIG. 2
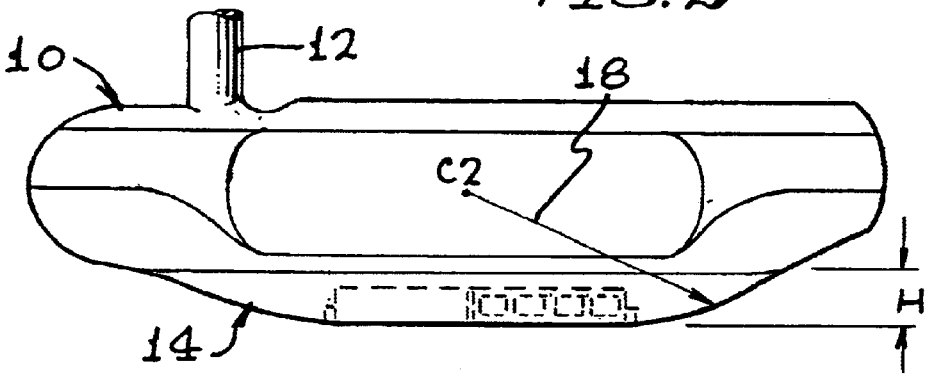
FIG. 3
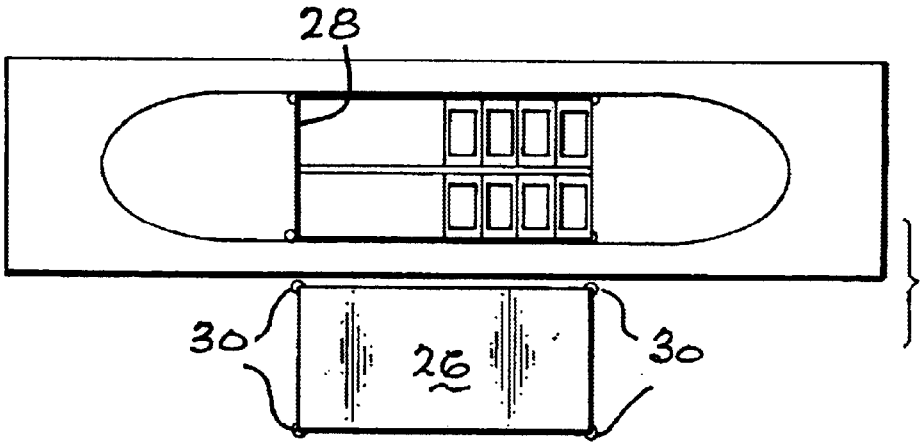
FIG. 4
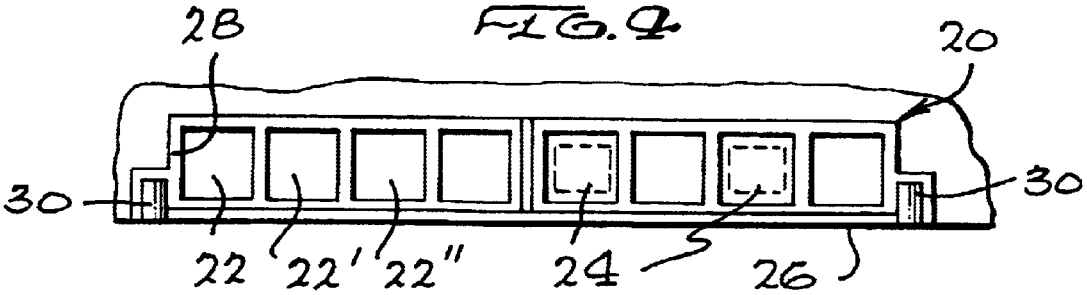

PUTTER HEAD CONSTRUCTION

BACKGROUND

1. Field of the Invention

The present invention relates generally to a golf putter, and, more particularly, to a putter head construction having modifiable weight distribution and lower putter head surface configured to present an outwardly extending convex curve in orthogonal planes.

2. Description of Related Art

In the game of golf, the putter is a club which has fixed geometric and dynamic features some of which are relatively constant and others of which may require changing as the owner tries changes in putting style, unknowingly develops bad putting habits, or develops swinging variations or inconsistencies brought on by aging. For example, striking a putted ball off the center of percussion can produce a tendency favor hitting the ball right of the hole ("push") or left of the hole ("pull"), rather than directly along a desired line of putting. Moreover, some golfers exhibit a tendency to hitting the putting surface with the leading lower edge of the putter face producing an errant shot or bouncing the putter head off the green surface producing an offline and uncontrolled hitting force. It is desirable for any golfer to remove these tendencies or biases from the putting aspect of the game.

A given golfer may find that a tendency has suddenly arisen in the putting game to hit right or left of the hole on short putts. This undesirable tendency can be overcome by deliberately striking the ball outwardly or inwardly, as the case may be, of the center of percussion. The one-sided putting tendency problem can also be compensated for by moving the center of percussion appropriately and this will be more particularly described in connection with the present invention

SUMMARY OF THE INVENTION

It is a primary aim and object of the present invention to provide a golf putter head having means for achieving predetermined locations of the center of percussion for the head.

Another object is the provision in a putter head of a double-convex sole plate surface reducing the possibility of making scuff contact with the putting green surface.

In accordance with the described invention a plurality of separate chambers are recessed in the lower surface of the putter head in side-by-side relation, each chamber being capable of receiving a weight of predetermined size, or alternatively may remain empty. In this way, the overall weight of the putter head can be modified and the center of percussion can be selectively shifted over a predetermined range to compensate for individual tendencies to putt a ball by striking off-center.

The chambers are closed off by a cover that lockingly snaps in place securing the enclosed weights against movement. The outer surface of the cover fits smoothly with the adjacent lower surface putter head material. Moreover, the cover and adjacent head material form a first convex curve about a first center of curvature and a second convex curve about a second center of curvature where the two centers of curvature are orthogonal to one another. The double-curved putter head lower surface reduces the club head contact area that can strike the green thereby increasing reliability of not dragging on the green.

BRIEF DESCRIPTION OF THE DRAWINGS

FIG. 1 is an end elevational view of a putter head of the present invention;

FIG. 2 is a front elevational view looking directly into the striking face;

FIG. 3 is a bottom plan exploded view of the invention showing the cover removed; and FIG. 4 is an enlarged fragmentary sectional view showing the cover in place over the weight chambers.

DESCRIPTION OF A PREFERRED EMBODIMENT

With reference now to the drawings and particularly FIGS. 1 and 2, a putter head portion 10 with hosel 12 for interconnection to a shaft (not shown) is depicted generally for illustrating the aspects of the invention. Prior known putters typically are provided with a bottom surface that is relatively flat and smooth. It is a fundamental aspect of this invention to provide a weight storing housing 14 accessible through the lower surface as will be described which presents a first convex lower surface curve 16 about a first center of curvature C1 (FIG. 1) and a second outwardly convex curve 18 about a second center of curvature C2 (FIG. 2). Best results have been obtained with the maximum extension (H) of the double-curved lower surface 16,18 from a completely flat condition lying within the range of 0.125–0.250 inches.

By having a double-curved lower surface, the areal surface that can contact the green while attempting a putt is reduced from that found in the prior putters with a flat smooth lower surface. A first advantage is that the tendency to scuff the lower surface of the head portion on the green is reduced and thus the possibility of ruining the putt from that source is reduced. This lower twin curved surface enables the player to tilt the putter club head portion a slight amount forwardly, backwardly along the line a putt is to move, and also tilt the head portion toward the toe or toward the hosel. All of these tilting adjustments can be performed as desired without increasing the tendency to dig or scuff any part of the club head into the green surface.

Additionally, the lower surface of the club head is hollowed out to receive a shelving member 20 in a fitting relation(FIGS. 3 and 4). The member 20 includes a plurality of individual compartments 22, 22', 22", 22'"—of identical size and all facing toward the club head bottom. A plurality of weights 24 are provided of such dimensions as to be individually and snugly received within a compartment 22. The location and number of weights inserted into the compartments is to be determined for the individual player and selected to overcome or reduce some bad habit of the player. For example, if the player (assumed to be right handed) tends to miss putts to the right (a "push") then it is advisable to add weights out toward the toe of the club head. If the player tends to miss to the left ("pull), then the weights should be added closer to the hosel.

When the weights have been selectively located within one or more compartments, a cover 26 of appropriate dimensions is snapped into place over the access opening 28 to the compartments which holds the weights tightly within the compartments so as not to rattle. The cover is generally rectangular and includes peglike members 30 at each corner which are received within openings closely adjacent the shelving member 20. The parts are so dimensioned that when the cover is in place the smooth curved lower surface of the club head is not disturbed.

Although the present invention is disclosed in connection with a preferred embodiment, it is to be understood that one skilled in the art may make modifications that come within the spirit of the invention as described and within the ambit of the appended claims.

What I claim is:

1. A golf putter head construction, comprising:

a head portion having a lower surface and a cavity formed in the head portion opening solely at the lower surface;

a shelving member fittingly mounted within the head portion cavity including a plurality of identical compartments all opening at the head portion lower surface;

a weight dimensioned for fitting receipt within any one of the compartments; and a cover engaged with the head portion over the cavity opening securing the weight within its receiving compartment against relative movement;

said cover and adjacent head portion lower surface forming a convexly extending surface curved about two different radii of curvature orthogonal to each other.

2. A golf putter head construction as in claim 1, in which the weight is selectively positioned within a particular compartment to shift the putter head portion center of percussion in a predetermined direction and amount.

3. A golf putter head construction as in claim 1, in which a plurality of weights are provided and located in a similar plurality of compartments to achieve a predetermined location of the head portion center of percussion.

4. A golf putter head construction as in claim 1, in which the cover includes a plurality of peg members which are arranged in identical configuration to an identical plurality of openings in the lower surface of the head portion, said peg members being received within said openings to retain the cover over the cavity.

5. A golf putter head construction as in claim 1, in which the maximum extension of the convexly curved cover and adjacent lower surface of the head portion from a flat condition is 0.250 inch.

6. A golf putter head construction as in claim 1, in which the maximum extension of the convexly surved cover and adjacent lower surface of the head portion from a flat condition is not less than about 0.125 inch.

* * * * *